US008424419B2

(12) United States Patent
Connell

(10) Patent No.: US 8,424,419 B2
(45) Date of Patent: Apr. 23, 2013

(54) BREAKOUT WRENCH SYSTEM

(75) Inventor: Stuart A. Connell, Sherman, TX (US)

(73) Assignee: Caterpillar Global Mining Equipment LLC, South Milwaukee, WI (US)

( * ) Notice: Subject to any disclaimer, the term of this patent is extended or adjusted under 35 U.S.C. 154(b) by 386 days.

(21) Appl. No.: 12/722,080

(22) Filed: Mar. 11, 2010

(65) Prior Publication Data

US 2011/0219917 A1 Sep. 15, 2011

(51) Int. Cl.
*E21B 19/16* (2006.01)
*B00B 13/50* (2006.01)

(52) U.S. Cl.
USPC ..... 81/57.34; 81/57.19

(58) Field of Classification Search ..... 81/57.34, 81/57.35, 57.16, 57.19, 57.2, 57.21; 173/164; 175/52, 85
See application file for complete search history.

(56) References Cited

U.S. PATENT DOCUMENTS

| | | | | |
|---|---|---|---|---|
| 3,680,412 | A * | 8/1972 | Mayer et al. | 81/57.34 |
| 3,683,466 | A | 8/1972 | Hughes | |
| 3,721,305 | A * | 3/1973 | Mayer et al. | 173/20 |
| 3,833,070 | A * | 9/1974 | Anderson | 81/57.34 |
| 3,977,480 | A * | 8/1976 | Hilding | 175/85 |
| 4,114,698 | A * | 9/1978 | Webb et al. | 173/164 |
| 4,147,215 | A | 4/1979 | Hodge et al. | |
| 4,194,419 | A | 3/1980 | Mitchhart et al. | |
| 6,206,096 | B1 | 3/2001 | Belik | |
| 7,090,254 | B1 | 8/2006 | Pietras et al. | |
| 2005/0076744 | A1 | 4/2005 | Pietras et al. | |
| 2005/0077743 | A1 | 4/2005 | Pietras et al. | |
| 2005/0166715 | A1 | 8/2005 | Rogers | |
| 2008/0169129 | A1 | 7/2008 | Patterson | |

FOREIGN PATENT DOCUMENTS

| | | | |
|---|---|---|---|
| WO | 2009027934 | A2 | 3/2009 |
| WO | 2009053874 | A2 | 4/2009 |

OTHER PUBLICATIONS

International Search Report and Written Opinion for PCT International Application No. PCT/US2011/021067, mail date Jul. 28, 2011, 7 pages.

* cited by examiner

*Primary Examiner* — Hadi Shakeri
(74) *Attorney, Agent, or Firm* — Foley & Lardner LLP

(57) ABSTRACT

A breakout wrench for use with a rock drill string includes a frame adapted for mounting to a rock drill feed guide structure, and a sub-frame rotatably connected to the frame about a drill string longitudinal axis. The sub-frame supports a pair of jaw members adapted for radial movement towards and away from one another and to releasably engage a first section of a drill string. The breakout wrench also includes a clamping member supported by the rock drill feed guide structure. The clamping member is adapted to releasably engage a second section of the drill string spaced axially from the first section.

3 Claims, 9 Drawing Sheets

BREAKOUT WRENCH SYSTEM

TECHNICAL FIELD

The invention relates to a breakout wrench and centralizer system for use in rock drilling operations.

BACKGROUND

A rock drill uses a drill string made up of drill rods and/or drill tubes, added to or taken away from the drill string, to achieve the required drilling depth for blast holes. The rock drill may use impact waves transmitted down the drill string along with rotation to the drill bit to fracture the formation being drilled into. During the drill string impact and rotation, the drill string joints may tighten and make them difficult to break loose from one other.

When the desired drilled hole depth is achieved, the drill rods and/or drill tubes are removed one at a time for storage. A typical method of breaking loose the joints between the rods or tubes is to stop drilling entirely while the drill string is at the bottom of the hole, reduce the feed pressure against the drill string, and start rattling. Rattling the drill rods and/or drill tubes is when the drill string rests against the bottom of the drilled hole and percussion impacts from the rock drill are used to impart compressive and tensile impact waves to loosen the drill string joints.

Some drill string components may be more difficult to break loose the joints than others due to a variety of reasons. Often an experienced driller can tell by the change in sound while rattling if the drill string joints have been broken loose. However, often only some of the joints are broken loose in a string, while others remain tightened, and the driller needs to use other means and/or methods to break the drill string joints loose.

SUMMARY

An embodiment of the invention includes a breakout wrench system for use with a rock drill string. The breakout wrench has a frame adapted for mounting to a rock drill feed guide structure, and a sub-frame rotatably connected to the frame about a drill string longitudinal axis. The sub-frame supports a pair of jaw members adapted for radial movement towards and away from one another and to releasably engage a first section of a drill string. The breakout wrench also has a clamping member supported by the rock drill feed guide structure, with the clamping member adapted to releasably engage a second section of the drill string spaced axially from the first section.

Another embodiment includes a breakout wrench for use with a rock drill string. The breakout wrench has a centralizer with a frame adapted for mounting to a rock drill feed guide structure, and a sub-frame rotatably connected to the frame about a drill string longitudinal axis. The sub-frame supports a first pair of jaw members adapted to engage and rotate a first section of a drill string using at least a pair of actuators. The breakout wrench also has a clamping assembly supported by the rock drill feed guide structure. The clamping assembly has a second pair of jaw members being actuated by at least a first actuator and a third pair of jaw members being actuated by at least a second actuator. The second pair of jaw members and third pair of jaw members are spaced axially apart from one another. The at least a first actuator and at least a second actuator are connected to a flow controller for moving the second pair of jaw members and the third pair of jaw members. The second pair of jaw members and the third pair of jaw members are adapted to releasably engage a second section of the drill string spaced axially from the first section.

A further embodiment includes a breakout wrench for use with a drill string. The breakout wrench has a first clamping assembly rotatably supported by a rock drill structure about a drill string longitudinal axis. The clamping assembly is adapted to secure and rotate a first section of the drill string during a breakout operation and adapted to centralize the drill string during a drilling operation. The breakout wrench also has a second clamping assembly supported by the rock drill structure, where the clamping assembly is adapted to secure a second section of the drill string during a breakout operation.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Figure 1:
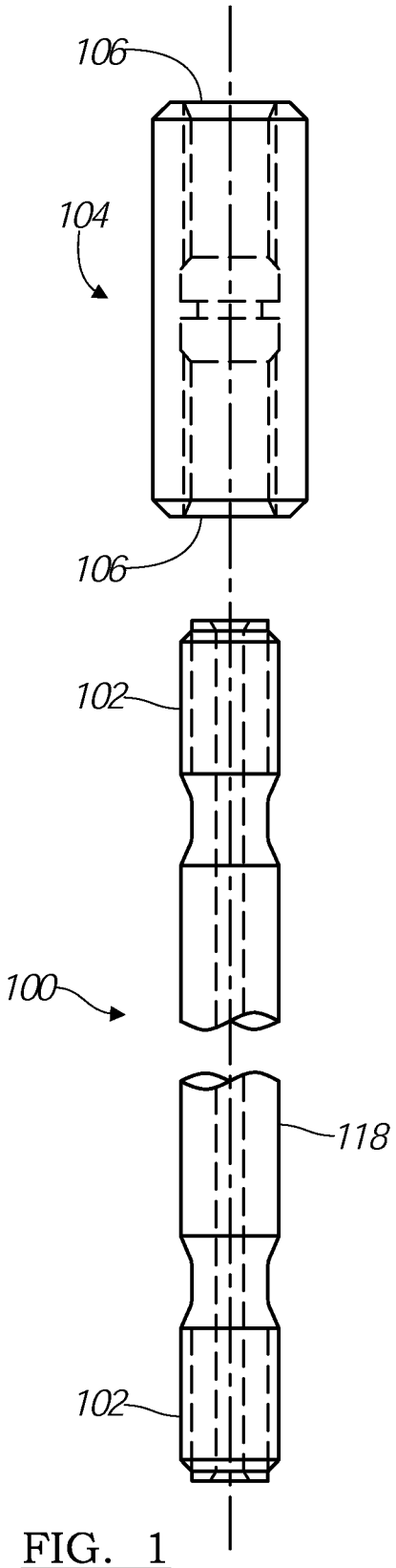
FIG. 1 is a side view of a male-male drill rod with a round body and a coupling.

A rock drill uses a drill string made up of drill rods and/or drill tubes, added to or taken away from the drill string, to achieve the required drilling depth for blast holes. Drill rods are commonly designed in different forms. FIG. 1 shows an example of a drill rod 100 with two male ends 102. In one embodiment the drill rod 100 is a tubular heavy wall rod with male threads at each end 102. A coupling 104 is used to connect adjacent drill rods 100 into a drill string. The coupling 104 has two female threaded ends 106, which are sized to receive the male ends 102 of the drill rod 100.

Figure 2:
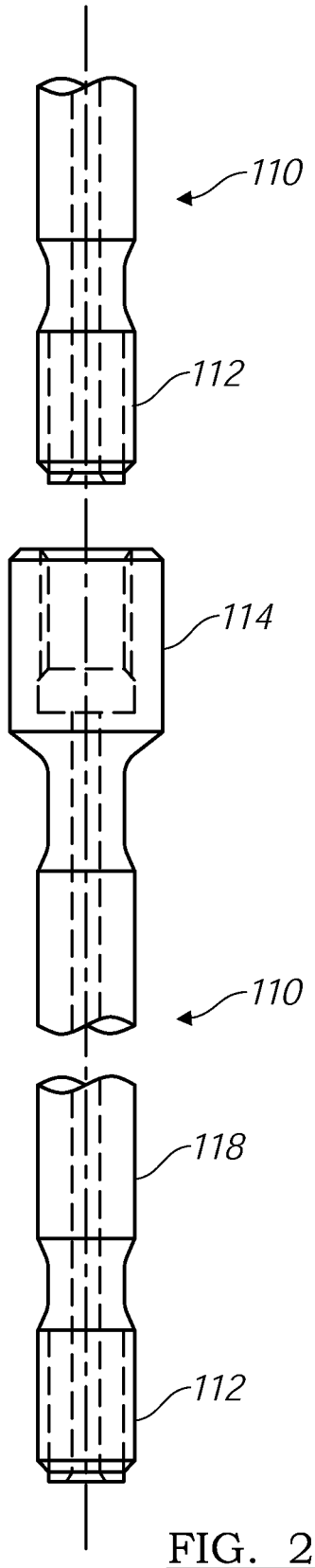
FIG. 2 is a side view of a male-female drill rod with a round body and a coupling.
Figure 3:
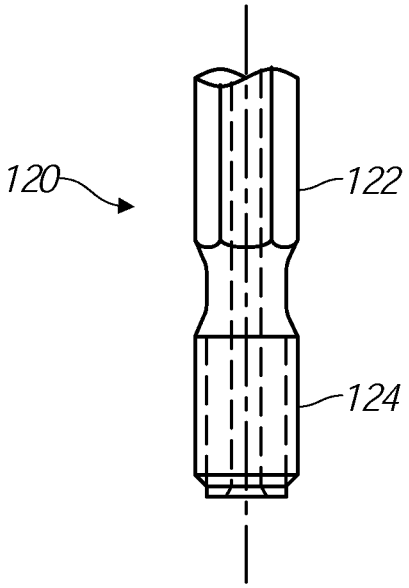
FIG. 3 is a side view of a male end of a drill rod with a hexagonal body.

FIG. 2 shows another embodiment of a drill rod 110, which has a male end 112 and a female end 114 on a tubular heavy wall rod. The drill rods 110 are joined to one another by connecting the male end 112 of a rod 110 into a female end 114 of an adjacent rod 110. FIGS. 1-2 depict drill rods 100, 112 with round bodies 118. FIG. 3 depicts an alternative embodiment of a drill rod 120 having a hexagonal body 122 and a male end 124. Various other rods and couplings are also contemplated according to economics and efficiencies.

Figure 4:
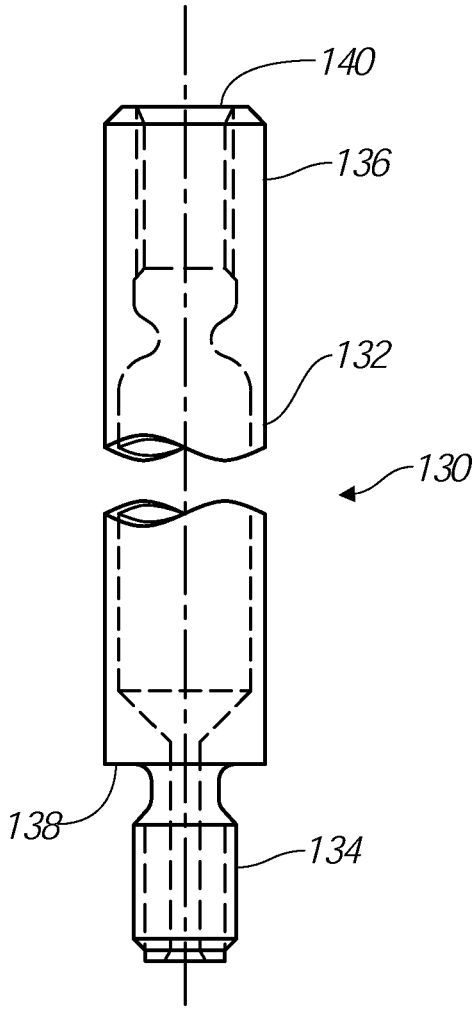
FIG. 4 is a side view of a male-female drill rod with a tubular body.

Additionally, the rod 130 may have a tubular body 132, as shown in FIG. 4, with a thinner wall section. In the embodiment shown, the tube rod 130 has a male end 134 and a female end 136, allowing the rod 130 to be joined to adjacent rods in a drill string. When the tube rods 130 are connected using the male and female ends 134, 136 of adjacent rods 130, the shoulder region 138 of a male end 134 may have contact with a shoulder region 140 of a female end 136, which may improve transmission of an impact wave from one rod 130 to another and down a drill string during a drilling or rattling operation.

Figure 5:
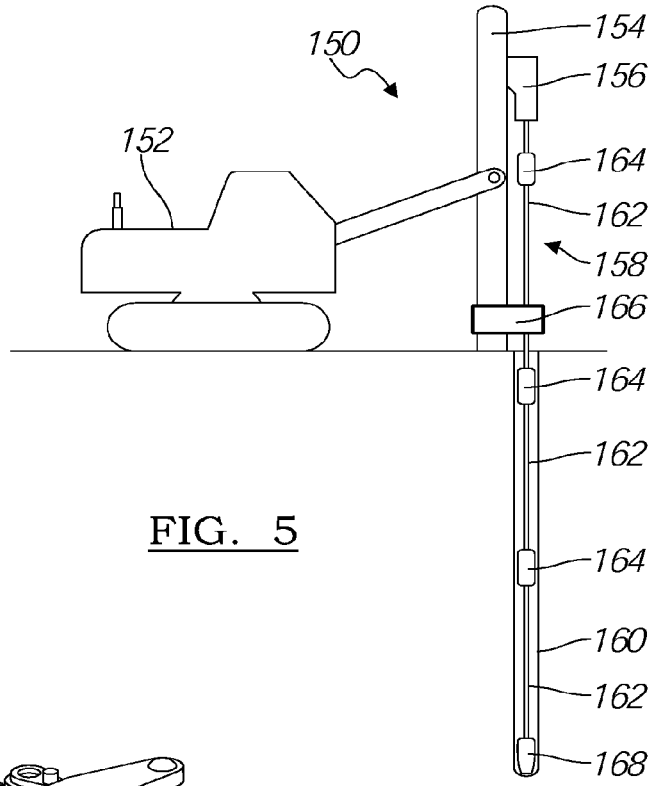
FIG. 5 is a schematic of a rock drill using drill rods or tubes in a drill string.

A schematic of a rock drill system 150 is shown in FIG. 5. A drill unit 152 has a drill feed guide 154. The drill feed guide supports a rock drill 156, which can travel linearly along the feed guide 154. The drill string 158 is connected to the rock drill 156 for drilling operations. The drill string 158 extends down into the drilled hole 160, and is made up of drill rods 162 or drill tubes such as those described previously in FIGS. 1-4. In this embodiment, several drill rods 160 are present and are connected using drill string connections 164. The drill string 158 passes through a centralizer 166, which is also attached to the drill feed guide 154. A drill bit 168 is connected to one of the drill rods 162. The rock drill system 150 may use impact waves when necessary to aid in the drilling process and fracture formations underground. During the drill string 158 impact and rotation, the drill string joints 164 may tighten and make them difficult to break loose from one other.

A typical method of breaking loose the joints 164 between the rods 162 or tubes is to stop drilling entirely while the drill string 158 is at the bottom of the hole 160, reduce the feed pressure against the drill string 158, and start what is often called "rattling". Rattling the drill rods 162 and/or drill tubes is when the drill string 158 rests against the bottom of the hole 160 and percussion impacts from the rock drill 156 are used to impart compressive and tensile impact waves to loosen the drill string joints 164.

Figure 6:
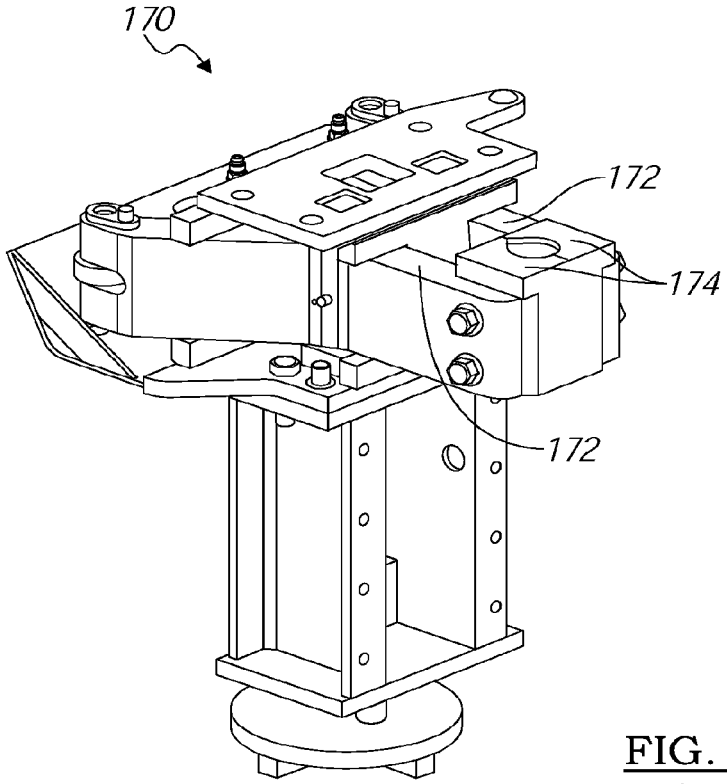
FIG. 6 PRIOR ART
FIG. 6 is a perspective view of a centralizer according to the prior art.

The centralizer 166 may be partially closed around the drill rod 162 and/or drill tube to provide centered support and centered guidance for the drill string 158 during drilling. A prior art centralizer 170 is shown in FIG. 6, and has two centralizer arms 172 and a pair of jaw members 174 to engage the drill rod 162 or to engage a connection 164.

To loosen a drill rod coupling 164, as shown in FIG. 5, the drill rod 162 and/or the drill tube is clamped in the centralizer 166 and the rock drill 156 rotates the drill rod 162 and/or drill tube to unscrew the joint 164. Some drill string 158 components may be more difficult to break loose the joints 164 than others due to a variety of reasons.

To remove the drill rods 162 and/or drill tubes from the hole 160 that has been drilled, the drill rods 162 and/or drill tubes are raised by the rock drill 156 until the bottom of the first drill rod 162 and/or drill tube is visibly just above the centralizer 166. The centralizer 166 clamps on the outside diameter of the coupling 164 or the outside diameter of the female portion of the drill rod 162 and/or drill tube. The rock drill 156 then reverses to unscrew the drill rod 162 above the centralizer 166 for storage. A similar reverse process is used for adding drill rods 162 to a drill string 162 during a drilling operation.

Figure 7:
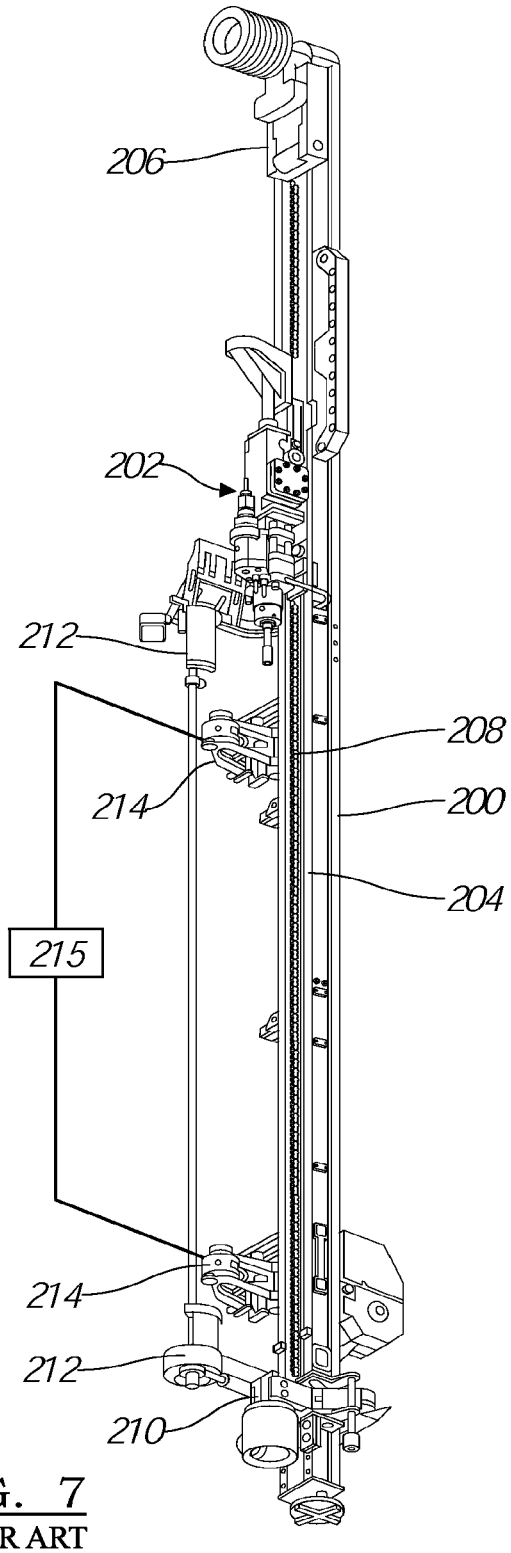
FIG. 7 PRIOR ART
FIG. 7 is a perspective view of a rock drill, centralizer, and rod changer according to the prior art.

FIG. 7 depicts a typical drill feed guide 200 and rock drill 202 for use with a drill unit. The rock drill 202 travels linearly along the feed guide 200 along tracks 204. The travel and position of the rock drill 202 is controlled using a motor 206 and chain 208, or other linear motion device. A prior art centralizer 210 is connected to the feed guide 200 and does not translate with the rock drill 202.

When the desired drilled hole 160 depth is achieved, the drill rods 162 and/or drill tubes are removed one at a time, using a method as described previously with the centralizer 210 clamping onto a drill rod connection and the rock drill 202 reversing to unscrew the connection. Rattling may also be used as necessary to loosen the connections. The loosened and removed drill rod 162 is stored in a rod changer device 212. Dependant of the design of the rod changer 212, the drill rod is held with grippers 214 of varying designs to position it into rod changer 212 slots or pockets. In one embodiment, the grippers 214 are hydraulically actuated for both clamping onto the drill rod 162 and translating the drill rod to the changer 212. The grippers 214 are connected to a flow controller 215 to control the movement. The flow controller may be connected to an electronic control module, which also provides for a user interface. Once the drill rod 162 and/or drill tube is stored in the rod changer 212, the rock drill 202 is then fed down the feed guide 200 and screwed into the drill rod and/or drill tube held in the centralizer 210 and the process repeats. The drill rod and/or drill tube removal procedure is used until the last rod is unattached from the rock drill 202.

Referring back to FIG. 5, in the event one or more drill rod and/or drill tube joints 164 had not broken loose from rattling, the driller would clamp onto the outside diameter of the coupling 164 attached to the drill rod 162 with the centralizer 166 and use the rock drill 156 to rattle the coupling 164 in the centralizer 166. Rattling the drill string using the centralizer 166 is used since it takes less time than adding rods 162 back to the drill string 158 and rattling the drill string 158 against the bottom of the hole 160 again. This procedure of rattling in the centralizer 166 can cause damage to the drill string 158 components and centralizer 166 components.

Figure 8:
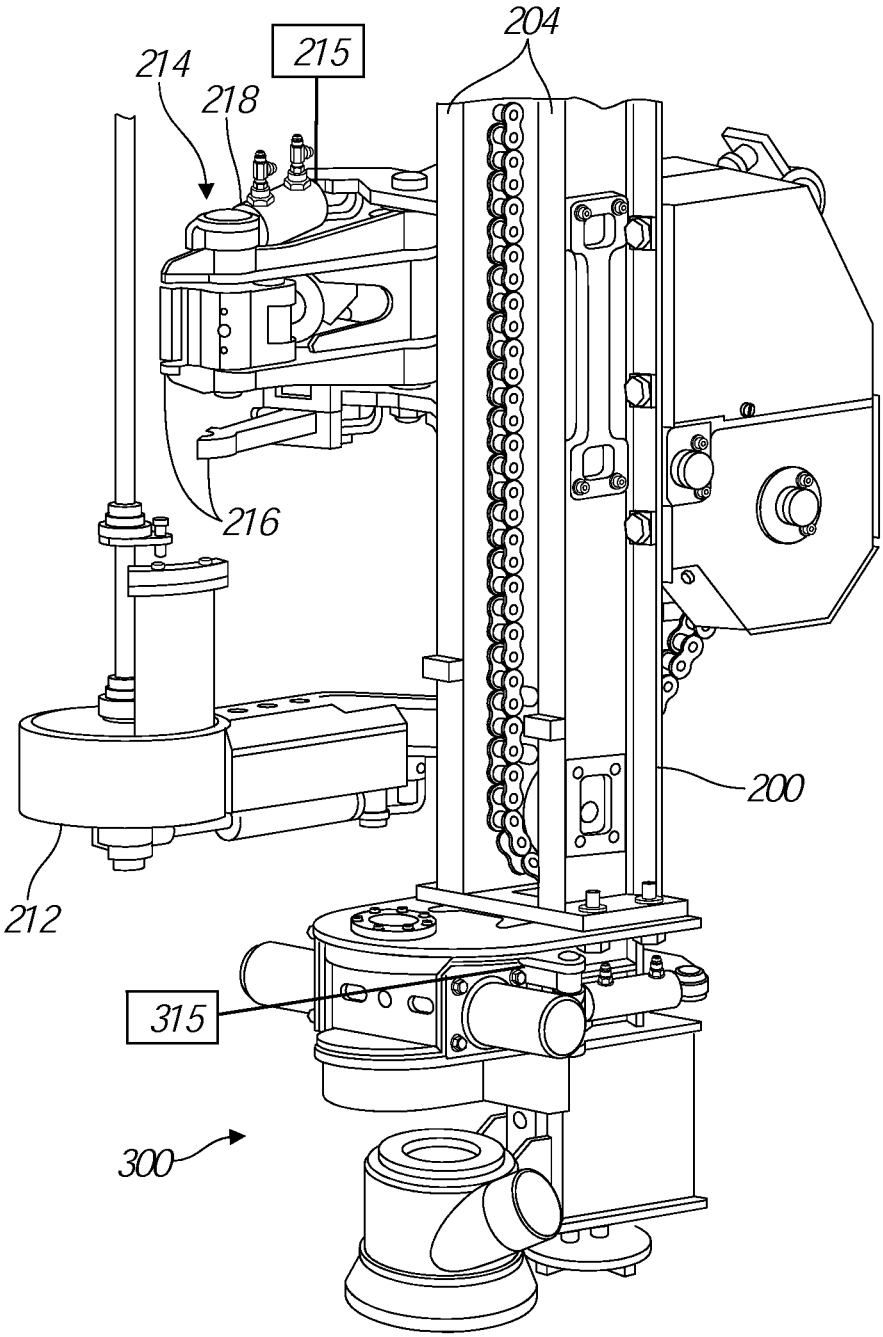
FIG. 8 is a partial perspective view a breakout wrench system and rod changer according to an embodiment of the present invention.

FIG. 8 depicts an embodiment of a powered breakout wrench system 300 which acts both as a centralizer and as a breakout wrench to aid in loosening a drill rod and/or drill tube connection. The wrench system 300 is shown attached to a feed guide 200 in place of the centralizer 210 of FIG. 7. The rod changer device 212 and one of the two grippers 214 are also shown in FIG. 8. In another embodiment, the system may have only one gripper 214. The drill string may still be rattled loose at the bottom of the hole if desired, but the breakout wrench system 300 provides a means of holding the drill rod and/or drill tube while rotating the drill string to aid in breaking of drill string joints, for example when one or more have not rattled loose while in the drilled hole. The rod grippers 214 secure the drill rod and/or drill tube to prevent twisting when the breakout wrench 300 is rotated to aid in breaking loose tightened joints. Once the drill rod and/or drill tube joints have been broken loose and the rock drill 202 has unscrewed from the drill string, the grippers 214 move the drill rod into the rod changer 212. The rod changer 212 may be a single changer or a carousel changer.

Each gripper 214 has a pair of jaw members 216, multiple jaw members, or other clamping mechanism for clamping onto and retaining a drill rod or drill tube, and it may lie along the drill string longitudinal axis when the grippers 214 are rotated to that position. The grippers 214 may be used to secure a second section or drill rod in a drill string, while the breakout wrench 300 rotates the first section to perform a breakout operation and loosen the joint or coupling between the first and second drill rods.

The jaw members 216 are actuated by an actuator 218, such as a hydraulic or pneumatic cylinder. Any number of actuators 218 are contemplated for use by a rod gripper 214. An additional actuator (not shown) may be used in one embodiment to rotate the rod gripper 214 for placing the drill rod into the changer 212. The actuator 218 is connected to a flow controller 215, which controls the movement of the jaw members 216 and of the rod gripper 214. The flow controller 215 may be connected to actuators 215 of more than one rod gripper 214 (as in FIG. 7) in order to move the jaws 216 or each gripper 214 in unison with one another. This allows for even clamping by multiple grippers 214 of the drill rod, which minimizes uneven loading or torquing of the drill rod. Alternatively, the flow controller 215 may contain a feedback mechanism such that the jaw members 216 are controlled to move and contact the drill rod simultaneously and apply even and equal loading across the multiple rod grippers 214. This may be useful if the drill rod or tube does not lie exactly along a longitudinal axis.

Figure 9:
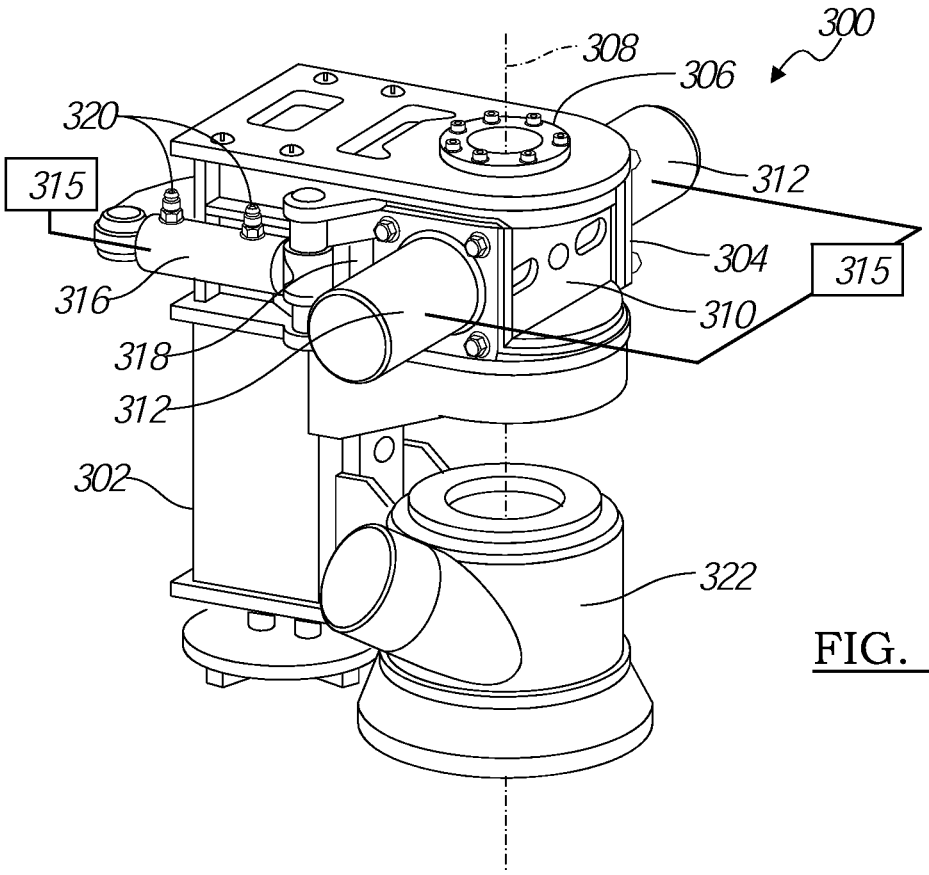
FIG. 9 is a perspective view of a breakout wrench according to another embodiment of the present invention.

FIG. 9 depicts the breakout wrench system 300 in detail for use with the rod gripper 214 of FIGS. 7 and 8. A frame 302 is used to connect the wrench system 300 to the feed guide 200. The frame 302 supports a sub-frame 304. A bearing assembly 306, bushing, or the like is used to connect the sub-frame 304 to the frame 302, and allow the sub-frame 304 to rotate about a longitudinal axis 308 of the drill string. The sub-frame 304 also supports a clamping assembly 310, such as a pair of jaw members, multiple jaw members, or other as is known in the art such that the clamping assembly 310 may partially close around the drill string to centralize it, or may clamp onto the drill string to secure it for a breakout operation. The clamping assembly 310 may also use a spring mechanism or other self-centralizing mechanism as is known in the art to centralize the drill string during a drilling operation. Alternatively, the clamping assembly 310 may be controlled to centralize the drill string using the jaw members. A dustpot 322 is also shown in FIG. 9 and is supported by the frame 302 and is spaced apart from the first clamping assembly 310.

Figure 10:
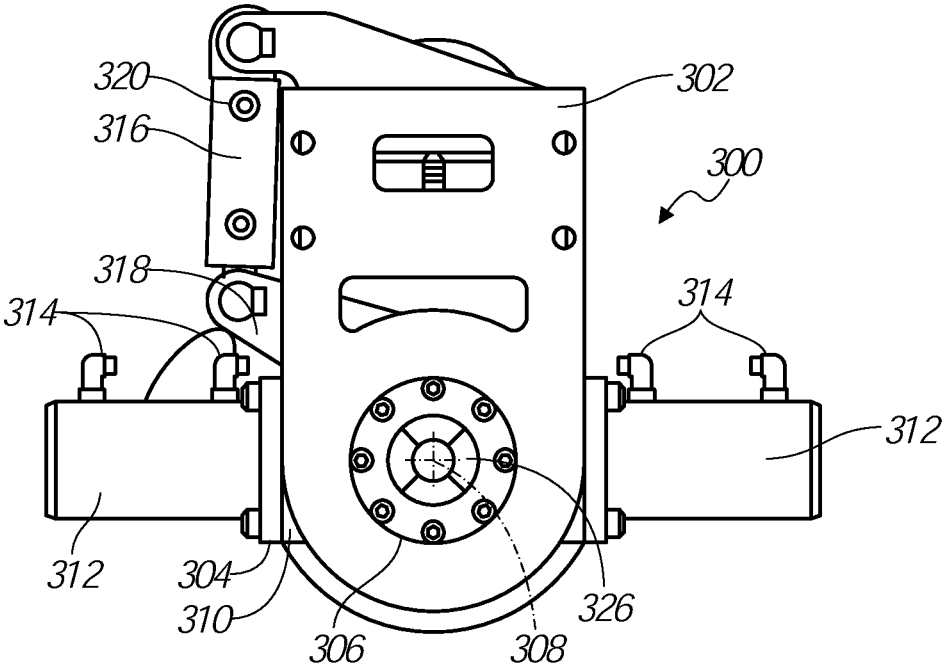
FIG. 10 is a plan view of the breakout wrench of FIG. 9 in a clamped position.

A pair of actuators 312 is used with the clamping assembly 310, although any number of actuators 312 may be used. The actuators 312 may be hydraulically powered, pneumatic, or the like, and may be double acting. As shown in FIG. 10, the actuators 312 are hydraulic and may have ports 314 for the fluid connections. The actuators 312 are mounted in line with the motion of the jaw members of the clamping assembly 310, although other orientations are contemplated. A flow controller 315 is connected to the actuators 312 in order to control the movement of the clamping assembly 310 to evenly grip to centralize a drill rod. The flow controller 315 may be integrated into flow controller 215 in one embodiment.

A third actuator 316 and linking arm 318 are shown connecting the frame 302 and the sub-frame 304, and are used for rotational motion of the clamping assembly 310. The actuator 316 has ports 320 for hydraulic connections of a double acting actuator; however, a pneumatic or other actuator is also contemplated. The actuator 316 is pivotally connected to the frame 302 and the sub-frame 304. When the actuator 316 extends, it exerts a force on the linking arm 318, which in turn moves and rotates the sub-frame 304 and clamping assembly 310. When the actuator 316 retracts, the linking arm 318 rotates the sub-frame 304 in the reverse direction. The actuator 316 may also be connected and controlled using the flow controller 315.

Figure 11:
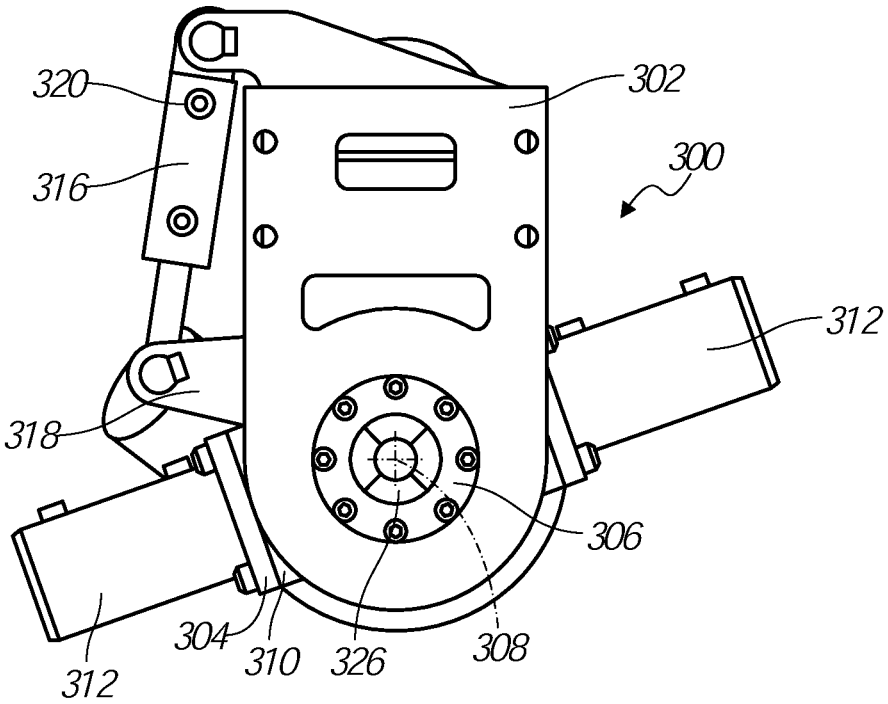
FIG. 11 is a plan view of the breakout wrench of FIG. 9 in a clamped and rotated position.

FIG. 10 shows a plan view of the breakout wrench 300 clamped onto a drill rod 326 and/or drill tube. FIG. 11 shows a top plan view of the breakout wrench 300 clamped onto a drill rod 326 and/or drill tube and rotated to break the joint loose. The pair of actuators 312 is shown in line with one another. The actuator 316 is extended in FIG. 11 to provide the rotation of the clamping assembly 310 by moving the linking arm 318 connected to the sub-frame 304 supporting the clamping assembly 310. The grippers 214 (See FIGS. 7-8) are also in a clamped or secured position about another section of the drill string, which is not rotating. The clamping assembly 310 rotates the first drill rod 326 through up to ninety degrees, while the second drill rod is held in place by the grippers 214, and the breakout operation is completed.

Figure 12:
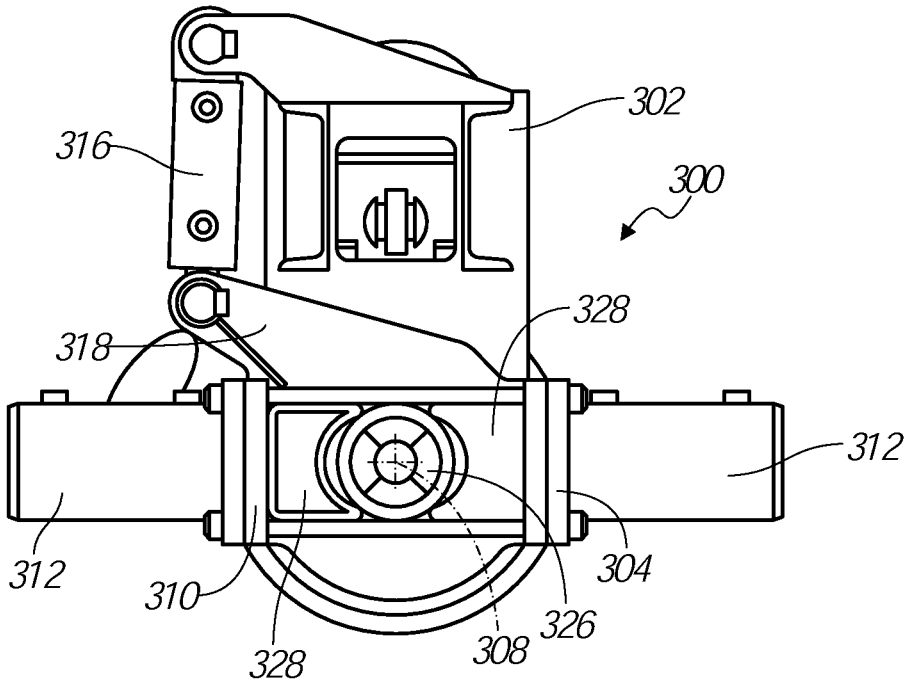
FIG. 12 is a sectional view of the breakout wrench of FIG. 9 in an unclamped and unrotated configuration.

FIGS. 12-15 depict section views of the breakout wrench 300 through its various states of operation. In FIG. 12, the clamping assembly 310 is shown in an un-clamped, un-rotated configuration. The pair of jaw members 328 is retracted and spaced apart from the first section 326 of the drill string. The actuators 312 are shown in line with the jaw members 328, and in a refracted position. Of course, other orientations of the actuators 312 are contemplated. The linking arm 318 is connected to the sub-frame 304 and connected to the third actuator 316, which is also in a retracted position. The third actuator 316 connects to the frame 302. The grippers 214 may be either unclamped from another section of the drill string, or clamped onto another section of the drill string at this time.

Figure 13:
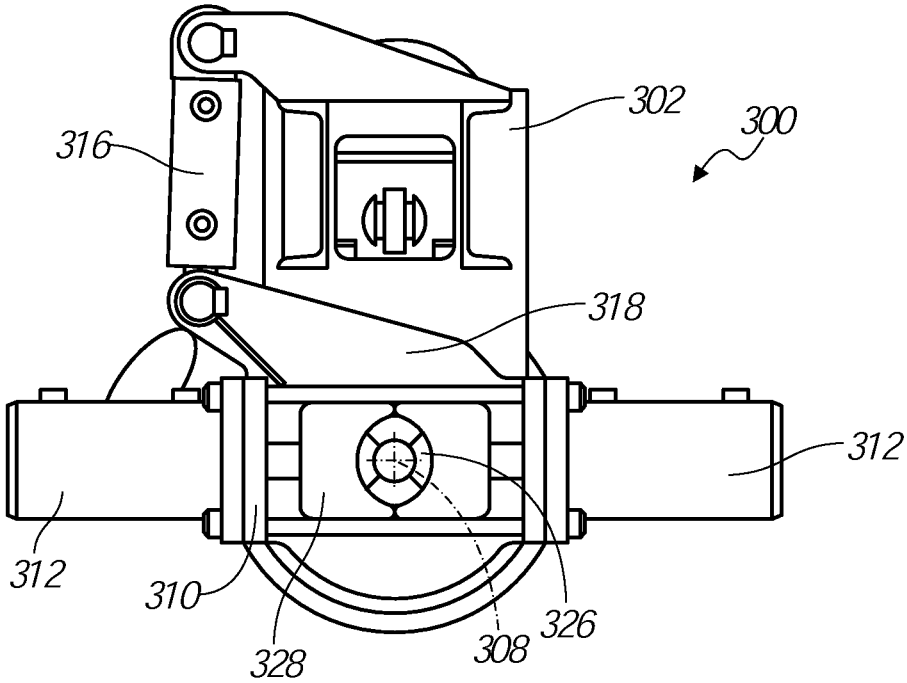
FIG. 13 is a sectional view of the breakout wrench of FIG. 9 in a clamped configuration.

FIG. 13 shows a section view of the breakout wrench 300 in a clamped, un-rotated configuration. The actuators 312 have extended the jaw members 328 towards one another such that the first section 326 of the drill string is secured. At this time, the grippers 214 (see FIGS. 7-8) may also be clamped about a second section of the drill string. In another mode (not shown), the pair of jaw members 328 are partially actuated to a position between that of FIGS. 12 and 13, and controlled to centralize a drill string during a drilling operation. The flow controller 315 controls the position of the jaw members 328 with respect to the longitudinal axis 308 and also potentially with respect to one another. Springs or other self-centralizing mechanisms (not shown) may also be used to bias the jaw members 328 into a position to centralize the drill string.

Figure 14:
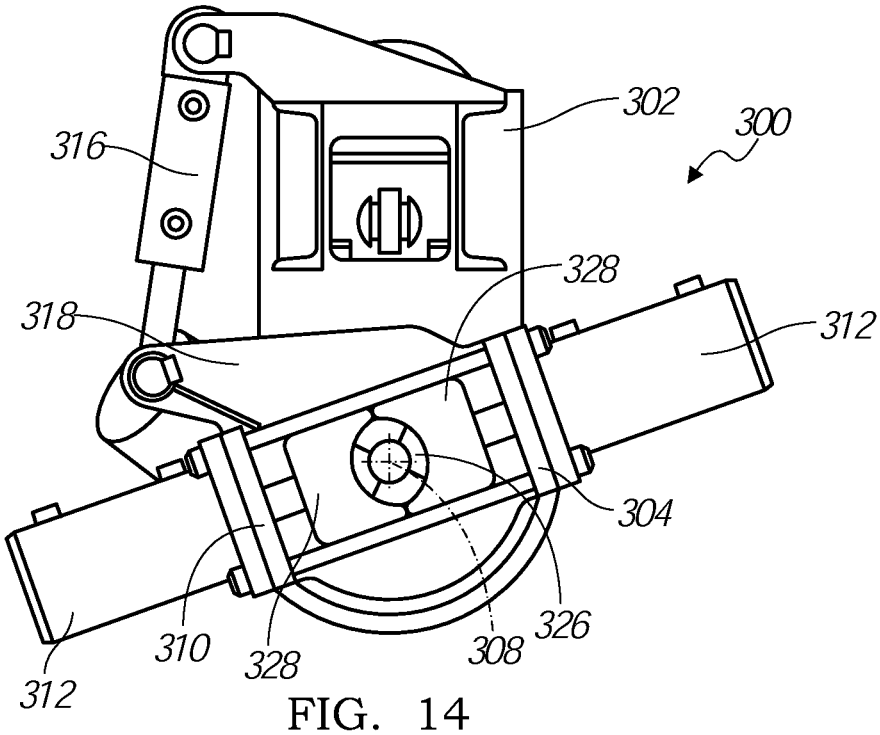
FIG. 14 is a sectional view of the breakout wrench of FIG. 9 in a clamped and rotated configuration.

FIG. 14 shows a section view of the breakout wrench 300 as it would look in a clamped and rotated configuration. The pair of jaw members 328 is in a clamped position securing the first section 326 of the drill string. The third actuator 316 extends to provide the rotation of the clamping assembly 310 about the drill string longitudinal axis 308 by moving the linking arm 318 connected to the sub-frame 304 supporting the clamping assembly 310. The clamping assembly 310 rotates the first drill rod 326 through up to ninety degrees, while the second drill rod is held in place by the rod grippers 214, and the breakout operation is completed.

Figure 15:
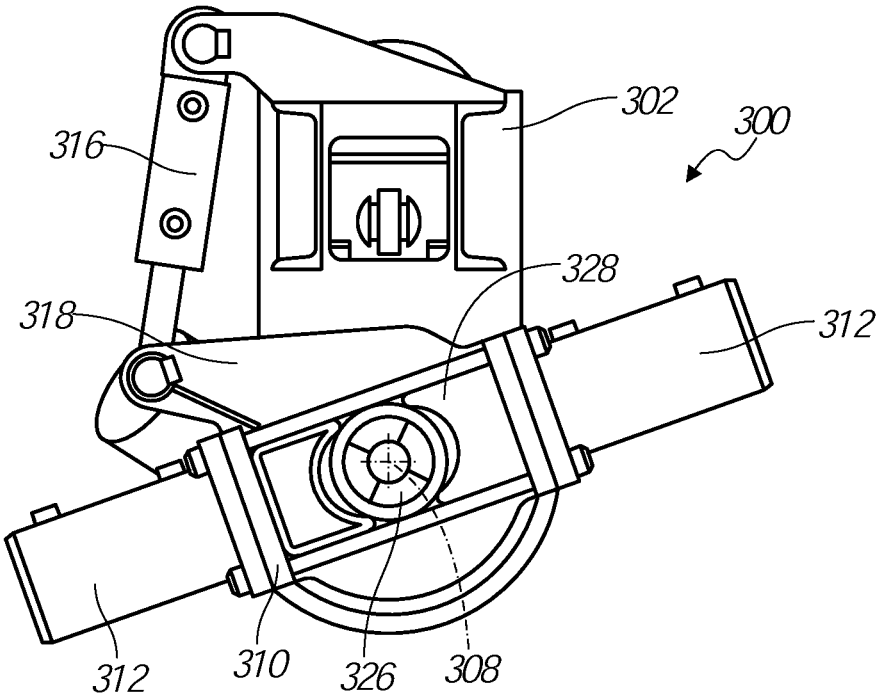
FIG. 15 is a sectional view of the breakout wrench of FIG. 9 in an unclamped and rotated position.

FIG. 15 shows a sectioned view of the breakout wrench 300 as it would look in an un-clamped and rotated configuration. The third actuator 316 remains extended, while the pair of actuators 312 have retracted the jaw members 328 from contact with the drill string 326.

The clamping assembly 310 then returns back to the configuration shown in FIG. 12 of an un-clamped, un-rotated configuration with the pair of jaw members 328 spaced apart from the first section 326 of the drill string. At this point, the joint will have been loosened such that adjoining drill string rods or sections can be separated from one another for storage. The rod grippers 214 may still secure the second drill rod for placement into the changer 212, while the rock drill is secured into the first section 326 in the drill string.

Referring now to FIGS. 7 and 8, during a breakout operation of the rock drill string, the rock drill 202 travels up the feed guide 204. The rod grippers 214 move in alongside the drill string and the jaws 216 clamp onto a first section or drill rod of the string in a controlled manner. The centralizer 300 also clamps onto a second section or drill rod of the string.

These two clamping operations may happen simultaneously, or in no particular order. Once both the grippers 214 and centralizer 300 have clamped onto the drill string, the centralizer 300 rotates the second section of the drill string with respect to the first section, which is held in place by the grippers 214.

Once the joint between the first and second sections of the drill string has been broken loose, the rod grippers 214 can release the first section of the drill string while the rock drill 202 unscrews it from the second string, which is held in place by the centralizer 300. Once the sections are separated, the rod grippers can clamp onto the first section, while the rock drill 202 disconnects from the first section, and then the first section can be moved to the rod changer 212. The centralizer 300 may unrotate at this point, while still clamping onto the drill string.

The rock drill 202 then travels down the feed guide 200 and connects with the second section held by the centralizer 300 and the remaining portion of the drill string. The centralizer may release the drill string, and un-rotate at this phase. The rock drill 202 and drill string then travel up the feed guide 200 and the process repeats for another drill rod removal.

This process may be repeated as many times as necessary to loosen any tightened drill string connections as the drill string is raised by the rock drill from the drilled hole.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A breakout wrench system for use with a rock drill string, the breakout wrench comprising:

a frame adapted for mounting to a rock drill feed guide structure;

a sub-frame rotatably connected to the frame about a drill string longitudinal axis, the sub-frame supporting a pair of opposed jaw members, each of the jaw members adapted for radial movement towards and away from one another and to releasably engage a section of a drill string;

a first and second actuator, each actuator supported by the sub-frame and connected to one of the pair of jaw members, each actuator for moving the respective jaw member;

a third actuator extending between the frame and the pair of jaw members, the third actuator for rotating the pair of jaw members about the drill string longitudinal axis;

a flow controller connected to the first and second actuator to control the movement of each of the pair of jaw members between a first unclamped position where the pair of jaw members are retracted from the section of the drill string, and a second clamped position where the pair of jaw members are clamped on the section of the drill string and configured to breakout the section of the drill string, and a third centralizing position where the pair of jaw members are positionable between the first unclamped position and the second clamped position and are operable in a centralizing mode to centralize the drill string during a drilling operation; and wherein the third actuator includes a linking arm having a length extending a sufficient distance from the sub-frame to provide the rotation of the sub-frame and the first pair of jaw members through an angular range of approximately ninety degrees about the drill string longitudinal axis.

2. The breakout wrench system of claim 1 wherein the first, second, and third actuators are hydraulic.

3. The breakout wrench system of claim 1, wherein the flow controller is operable to move the pair of jaw members in unison and to apply a substantially even and equal loading on the section of the drill string in the second clamped position.

* * * * *